10/15/85 XT 4,546,492

United States Patent [19]

Dickenson

[11] Patent Number: 4,546,492

[45] Date of Patent: Oct. 15, 1985

[54] GARMENTS AND/OR METHODS OF PROTECTING GARMENTS

[75] Inventor: Alfred J. Dickenson, Auckland, New Zealand

[73] Assignee: Moray Industries Limited, Devonport, New Zealand

[21] Appl. No.: 541,051

[22] Filed: Oct. 12, 1983

[30] Foreign Application Priority Data

Mar. 18, 1983 [NZ] New Zealand ..... 203624
Jun. 19, 1983 [NZ] New Zealand ..... 204749

[51] Int. Cl.[4] ..... A41D 27/12
[52] U.S. Cl. ..... 2/46; 2/2.5
[58] Field of Search ..... 2/2.5, 227, 80, 24, 2/46, 187, 51; 128/544

[56] References Cited

U.S. PATENT DOCUMENTS 921,352 5/1909 Blaker et al. ..... 112/55
1,021,804 4/1912 Schneider ..... 2/2.5
1,269,930 6/1918 Hawley ..... 2/2.5
1,282,411 10/1918 Golembiowski ..... 2/2.5
4,322,858 4/1982 Douglas ..... 2/51

*Primary Examiner*—Doris L. Troutman
*Attorney, Agent, or Firm*—Holman & Stern

[57] ABSTRACT

A garment, and method of making it, formed from a flexible material having part thereof covering a body joint subjected to stretching upon movement of the body joint in use, has a plurality of sections of flexible sheet material overlying that part of the garment to protect it against wear and arranged in overlapping relationship so that part of one section overlies part of an adjacent section and the sections lie substantially parallel to and partly in engagement with each other and partly against the surface of the garment, the sections being attached to the garment along substantially parallel spaced lines substantially perpendicular to the stretching direction so that the flexibility of the garment is not impaired in the stretching direction.

14 Claims, 5 Drawing Figures

GARMENTS AND/OR METHODS OF PROTECTING GARMENTS

BACKGROUND OF THE INVENTION

1. Field of the Invention

This invention relates to garments and/or methods of protecting garments.

2. Brief Summary of the Invention

It is an object of the present invention to provide a garment and/or a method of protecting a garment.

Accordingly, in one aspect, the invention consists in a method of protecting part of the surface of a garment formed from a flexible material, said method comprising the steps of fixing a plurality of sections of flexible sheet material on that part of the garment surface which is to be protected, said sections of sheet material being arranged to lie substantially parallel to and/or against the surface to be protected and so that part of at least one of said sections overlies part of another of said sections, said sections being fixed in a position and a manner such that the flexibility of the garment is not inhibited by said sections along a predetermined direction.

In a further aspect the invention consists in a garment formed from a flexible material and having a plurality of sections of flexible sheet material adhered to a surface part thereof which is to be protected, said sections of sheet material being arranged to lie substantially parallel to and/or against the surface of said garment so that part of at least one of said sections overlies part of another of said sections, said sections being fixed in a position and a manner such that the flexibility of the garment is not impaired by the addition of said sections along a predetermined direction.

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

BRIEF DESCRIPTION OF THE DRAWINGS

One preferred form of the invention will now be described with reference to the accompanying drawings wherein.

DETAILED DESCRIPTION

Figure 1:
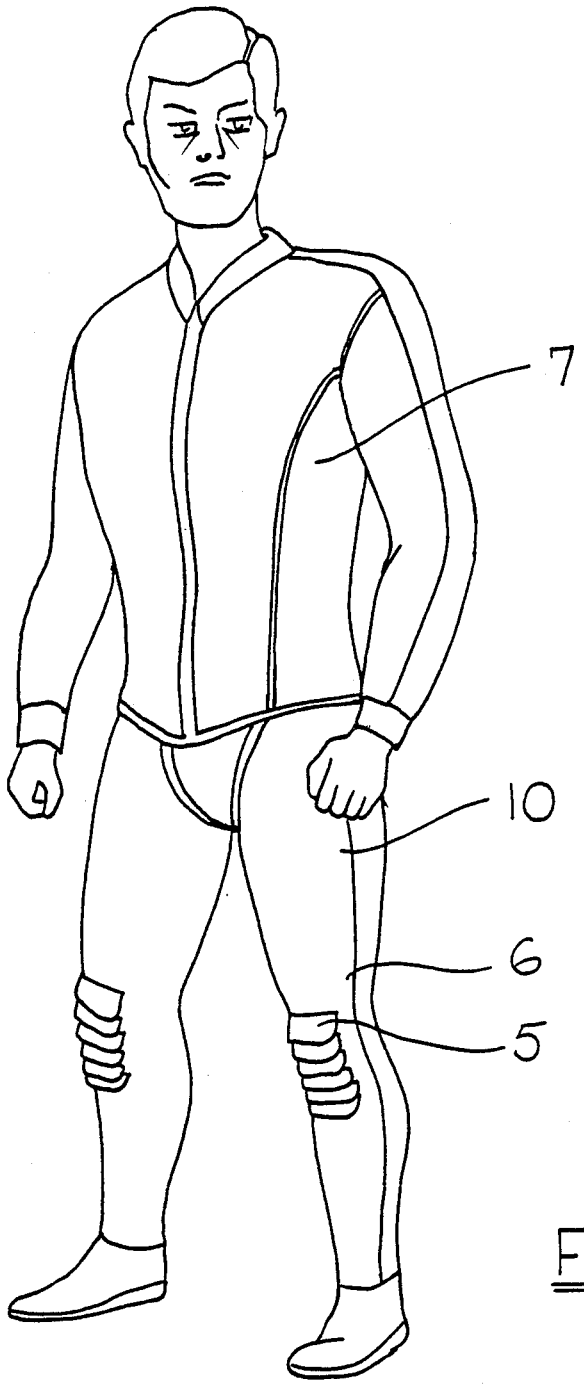
FIG. 1 shows a perspective view of a garment provided with protection according to the invention.

Referring to the drawings and in particular to FIGS. 1 to 4, according to the invention a method of adding protection to a garment comprises the steps of fixing a plurality of sections of flexible and preferably elastic sheet material indicated by reference numeral 5 to the surface of that part 6 of a garment which it is desired to protect. As can be seen the sections 5 are attached in a manner such that at least part of one of the sections 5 overlaps at least part of one of the other sections, and the sections are further attached in a position and manner such that the flexibility and/or elasticity of the garment 7, at least along one predetermined direction, is not impaired.

Figure 3:
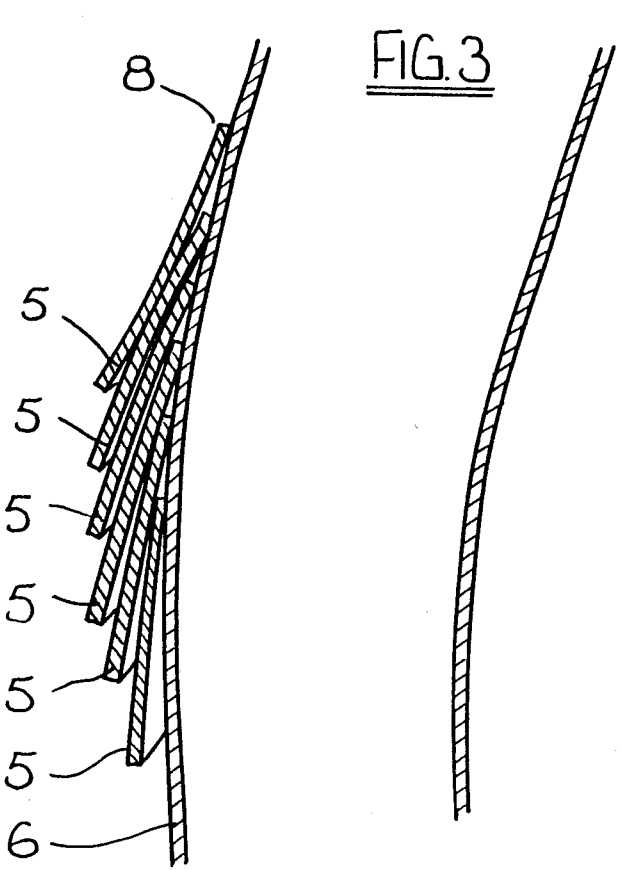
FIG. 3 shows a cross-sectional view of the garment section taken along line II—II in FIG. 2.
Figure 2:
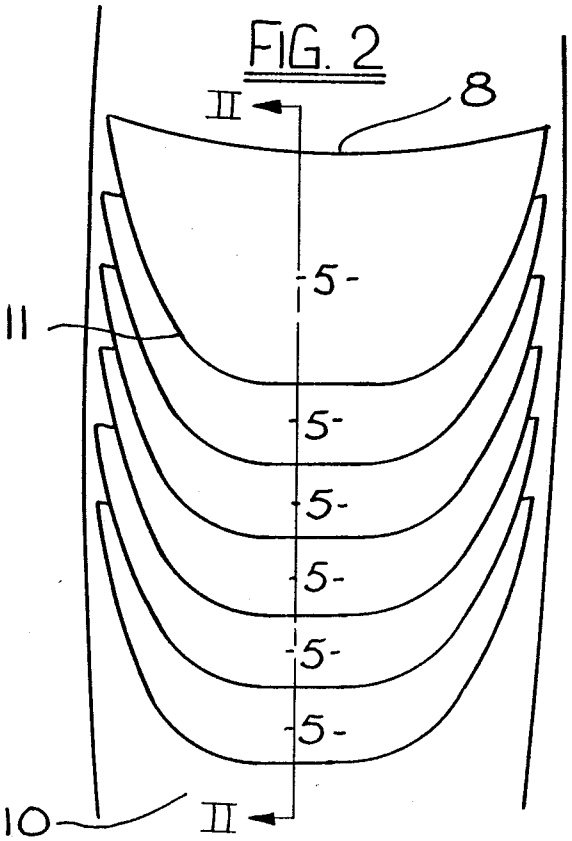
FIG. 2 shows an enlarged front elevational view of that part of the garment shown in FIG. 1 which includes the protection according to the invention.
Figure 4:
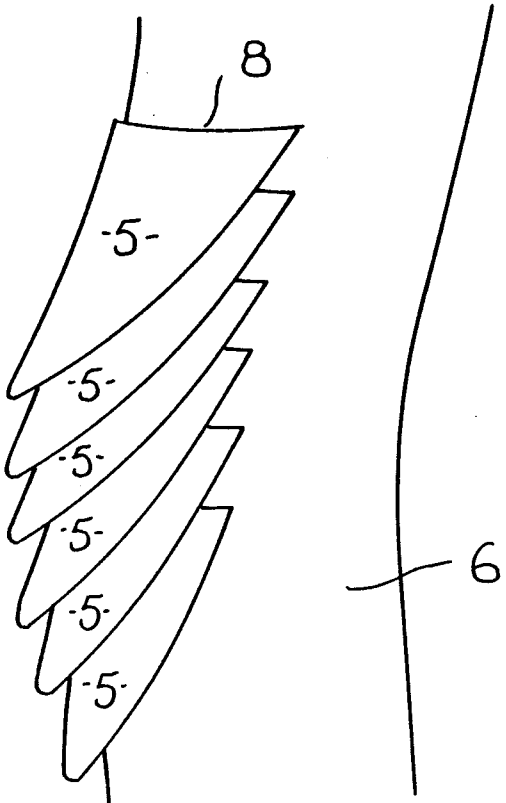
FIG. 4 shows a right side elevational view of the garment part shown in FIG. 2.

As can be seen each of the sections 5 is preferably the same or substantially the same shape and is preferably fixed to the garment 7 along spaced substantially parallel lines, the fixing line being indicated by reference numeral 8 in FIGS. 2 to 4.

The invention has been devised particularly, though not necessarily solely, to provide means to protect or enhance the strength of various sections of garments used in acquatic pursuits such as diving, yachting, board-sailing, surfing etc. In the embodiment shown the sections 5 are fixed to the knee covering 9 of a diver's wet or dry suit and as can be seen the sections 5 are adhered to the outer surface of the diver's suit along lines substantially transverse to the axis of the leg 10. As a result the provision of sections 5 does not impair the flexibility and/or elasticity of garment 7 along the leg and thus does not impair the ability of the garment wearer to bend his knee. As can be seen the fixing edge 8 of each of the sections 5 is slightly curved and arranged to define the upper edge of the section 5 so that as the diver moves through the water the fixing line 8 constitutes the leading edge of the section or patch 5 and ensures that water flow biases each of the sections 5 substantially against the outer surface of the leg covering. The provision of slightly curved fixing line 8 also assists in ensuring that the sections 5 lie flat against the outer surface of the garment knee when the garment is in use.

Each section or patch may, as shown, have an arcuate edge 11 joining opposite ends of fixing line 8 or may be formed in any other suitable shape such as, for example, that of a rectangle and each of the sections 5 is preferably adhered and/or stitched to the outer surface of the leg 10 along the fixing lines 8.

The drawings depict a construction in which six sections or patches 5 are provided. The number of patches is, however, not generally critical but obviously at least two such sections must be provided. Generally three to six sections will be provided.

Figure 5:
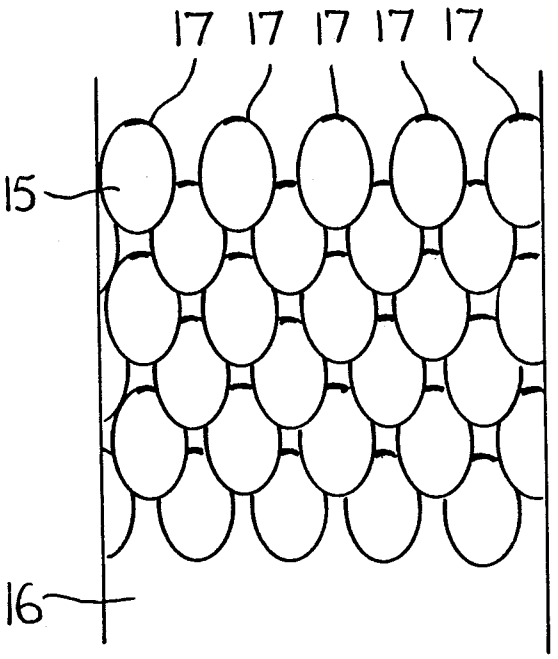
FIG. 5 shows a front elevational view similar to FIG. 2 of part of a garment provided with an alternative form of protection according to the invention.

Turning now to FIG. 5 a further embodiment of protective covering according to the invention is depicted in which sections 15 of flexible and preferably elastic material are provided which are shown fixed to the knee parts of a garment leg 16 along two sets of parallel lines, one set of lines running longitudinally of the garment leg 16 and the other set extending transverse to the leg. It will also be seen that the sections 15 along any one line are staggered with respect to, and overlapped with, the sections 15 in adjacent lines.

It will be noted that each of the sections 15 is preferably the same or substantially the same shape and is preferably fixed to the garment 16 along fixing line 17.

As can be seen the sections 15 are oval shaped and, as with the embodiment described above, the fixing line 17 of each of the sections 15 is at or adjacent the upper edge thereof so that as the wearer moves forward through the water the fixing line 17 constitutes the leading edge of the section or patch 15 and ensures that water flow biases each of the sections 15 substantially against the outer surface of the leg covering. Again some curvature of the fixing line 17 may be provided to ensure that the patch normally lies against the garment surface when the garment is in use and fixing is generally effected by gluing and/or stitching along fixing line 17, although fixing could also be achieved by rivetting and/or lacing.

The number of sections is not generally critical and, as with the embodiment previously described, will depend on the size and shape of the individual sections. The shape may vary from that depicted and, by way of example, the patches could be circular, tear-drop, square, rectangular or triangular in shape. Whatever shape is chosen, generally the sections are smaller and provided in greater numbers in those areas where the parent garment is subjected to the greatest movement.

It will be appreciated that the overlapping arrangement of the sections 15 not only imparts the required protection to the garment section 16 but since the fixing lines 17 are very short, the provision of the protection does not limit the flexibility and/or elasticity of the garment to any appreciable extent as does a conventional protection path fixed around all its borders.

Whichever embodiment is depicted, it will be noticed that because the protective patches or sections are formed from flexible material and are fixed along a single line, the alignment thereof can be reversed by hinging or bending the individual patches about their fixing lines with minimal risk of damage occurring. This is particularly important for divers as, if reversal of alignment were not possible, there would be some risk of projecting obstacles snagging the protective sections.

In both of the embodiments depicted and described, the protective sections are fixed to the garment over the knee area which is a particularly vulnerable area for divers, but such sections could also be fixed to the elbow, shoulders and/or seat sections of a garment or indeed in any position where the garment needs extra protection or covering.

The sections 5 and 15 are preferably formed from the same material as the parent garment, e.g. NEOPRENE, and as shown, are fixed directly to the trouser section of a diver's suit but could be attached to individual leg/-sleeves which the diver dons if necessary or desired.

While the invention has been developed initially for use by underwater divers and others engaging in acquatic pursuits, similar garment protection or padding could be applied to the clothing worn by persons engaging in other pursuits such as, for example snow skiers and/or motor-cyclists.

The invention thus provides a method of and/or means for enhancing the wear resistance of clothing yet does not inhibit movement of the wearer's limbs which is typically the case with garments provided with protective patches fixed about all borders.

What is claimed is:

1. In a garment formed from a flexible material and having at least one part thereof covering a body joint and subjected to stretching in at least one stretching direction upon movement of the body joint in use, the improvement comprising:

a plurality of sections of flexible sheet material overlying said at least one part of the garment to protect said at least one part against wear and being arranged in overlapping relationship so that part of at least one of said sections overlies part of an adjacent section and said sections lie substantially parallel to and partly in engagement with each other and at least partly against the surface of the garment; and means to attach said sections to the garment along substantially parallel spaced lines substantially perpendicular to the at least one stretching direction so that the flexibility of the garment is not substantially impaired in the at least one stretching direction.

2. The improvement as claimed in claim 1 wherein each of said sections is the same size and shape on any part of said garment.

3. The improvement as claimed in claim 2 wherein each section has a top edge and said attaching lines are on the top edges of said sections when the garment is upright.

4. The improvement as claimed in claim 3 wherein each section has an arcuate border having ends joining the opposite ends of said attaching line.

5. The improvement as claimed in claim 3 wherein said sections are oval shaped.

6. The improvement as claimed in claim 3 wherein said garment has leg and arm parts having knee and elbow portions, said sections are attached to the knee and/or elbow portions, and the attaching lines are transverse to the general longitudinal axis of the respective leg and/or arm.

7. A garment as claimed in claim 1 wherein said sections are elastic material.

8. The improvement as claimed in claim 3 wherein said sections are tear-drop shaped.

9. The improvement as claimed in claim 4 wherein said garment has leg and arm parts having knee and elbow portions, said sections are attached to the knee and/or elbow portions, and the attaching lines are transverse to the general longitudinal axis of the respective leg and/or arm.

10. The garment as claimed in claim 9 wherein said sections are elastic material.

11. The improvement as claimed in claim 5 wherein, a plurality of said sections are arranged in spaced relationship along each attaching line and are staggered with respect to said plurality of sections along the adjacent attaching line.

12. A garment as claimed in claim 11 wherein said sections are elastic material.

13. A method of protecting a part of the surface of a garment which in use is subjected to stretching in a main stretching direction caused by movement of a body joint, comprising:

arranging a plurality of sections of flexible sheet material to overlie the part of the surface to be protected in overlapping substantially parallel relationship with respect to each other so that part of at least one of said sections overlies in contacting relationship with part of an adjacent section, and part of each section is in contact with and is substantially parallel to the surface; and attaching said sections to the surface along spaced lines extending substantially perpendicular to the main stretching direction of the part.

14. A method as claimed in claim 13 wherein said garment has leg and elbow portions, and said sections are attached to the knee and/or elbow portions along lines substantially tranverse to the general longitudinal axis of the respective leg and/or arm.

* * * * *